US005197278A

United States Patent [19]

Sabla et al.

[11] Patent Number: 5,197,278

[45] Date of Patent: Mar. 30, 1993

[54] DOUBLE DOME COMBUSTOR AND METHOD OF OPERATION

[75] Inventors: Paul E. Sabla, Cincinnati; Willard J. Dodds, West Chester; Donald W. Bahr, Cincinnati, all of Ohio

[73] Assignee: General Electric Company, Cincinnati, Ohio

[21] Appl. No.: 628,290

[22] Filed: Dec. 17, 1990

[51] Int. Cl.[5] ..... F02C 7/22

[52] U.S. Cl. ..... 60/39.02; 60/747; 60/748; 60/733

[58] Field of Search ..... 60/39.02, 746, 747, 60/748, 39.36, 733

[56] References Cited

U.S. PATENT DOCUMENTS

| | | | |
|---|---|---|---|
| 2,951,339 | 9/1960 | Benson . | |
| 3,643,430 | 2/1972 | Emory, Jr. et al. . | |
| 3,653,207 | 4/1972 | Stenger et al. . | |
| 3,788,065 | 1/1974 | Markowski | 60/39.02 |
| 3,872,664 | 3/1975 | Lohmann et al. . | |
| 4,074,520 | 2/1978 | Mansson et al. | 60/39.32 |
| 4,173,118 | 11/1979 | Kawaguchi . | |
| 4,194,358 | 3/1980 | Stenger | 60/39.06 |
| 4,195,475 | 4/1980 | Verdouw | 60/754 |
| 4,246,758 | 1/1981 | Caruel et al. | 60/747 |
| 4,253,301 | 3/1981 | Vogt | 60/39.46 |
| 4,305,255 | 12/1981 | Davies et al. | 60/741 |
| 4,356,698 | 11/1982 | Chamberlain | 60/733 |
| 4,374,466 | 2/1983 | Sotheran | 60/39.36 |
| 4,399,652 | 8/1983 | Cole et al. | 60/39.465 |
| 4,499,735 | 2/1985 | Moore et al. | 60/739 |
| 4,603,548 | 8/1986 | Ishibashi et al. | 160/39.06 |
| 4,763,481 | 8/1988 | Cannon | 60/737 |
| 4,903,492 | 2/1990 | King | 60/733 |

FOREIGN PATENT DOCUMENTS 2412120 9/1974 Fed. Rep. of Germany .

OTHER PUBLICATIONS

S. J. Markowski et al, The Vorbix Burner—A New Approach to Gas Turbine Combustors, ASME 75-G-T-20, Mar. 2-6, 1975.

R. E. Jones, Advanced Technology for Reducing Aircraft Engine Pollution, Transactions A.S.M.E., Nov. 1974, pp. 1354-1360.

Dr. G. J. Sturgess, Advanced Low-Emissions Catalytic Combustor Program Phase I Final Report, NASA CR-159656, Jun. 1981, pp. i-iv, 1, 15-17, 20, 31, 41, 48, 57, 71, 92, 93, 125-128, 141 and 142.

D. L. Burrus et al, Combustion System Component Technology Development Report, NASA R82A-EB401, Nov. 1982, pp. cover and title pp. 1-37, 455-462 and 464.

Arthur H. Lefebvre, Gas Turbine Combustion, 1983, pp. 22, 23, 25, 492, 493.

*Primary Examiner*—Richard A. Bertsch
*Assistant Examiner*—Timothy S. Thorpe
*Attorney, Agent, or Firm*—Jerome C. Squillaro; James P. Davidson

[57] ABSTRACT

A method of operating a double dome combustor includes channeling compressed airflow through an inner dome for generating inner combustion gases having an inner reference velocity greater than an outer reference velocity of outer combustion gases generated from compressed airflow channeled through an outer dome, and diffusing the outer and inner combustion gases in outer and inner combustion zones. One double dome combustor effective for practicing the method in accordance with the present invention includes outer and inner combustor liners and domes, with the domes having outer and inner carburetors disposed therein, respectively. The inner carburetors are sized for generating inner combustion gases in the inner combustion zone having an inner reference velocity greater than an outer reference velocity of the outer combustion gases generated in the outer combustion zone. In a preferred embodiment, the combustor includes an annular centerbody which, along with the combustor outer and inner liners, defines diverging outer and inner combustion zones.

14 Claims, 3 Drawing Sheets

DOUBLE DOME COMBUSTOR AND METHOD OF OPERATION

TECHNICAL FIELD

The present invention relates generally to combustors for aircraft gas turbine engines, and, more specifically, to a double dome combustor.

BACKGROUND ART

Present combustors used in gas turbine engines for powering aircraft in flight include radially outer and inner combustion liners and a single annular dome joining upstream ends thereof. The single dome includes a plurality of circumferentially spaced carburetors each including a fuel injector nozzle and a conventional air swirler for providing a fuel/air mixture into the combustor. The combustor has a burning length defined between the dome at the fuel injector nozzle to the leading edge of a conventional turbine nozzle disposed at the outlet of the combustor. The combustor also has a dome annulus height measured between the outer and inner liners at the dome end of the combustor.

Since the combustor is used in powering an aircraft in flight, it must operate over a wide range of power conditions from low power at ground idle to high power at takeoff, for example. Performance of the combustor is evaluated by several conventional parameters including the degree of uniformity of the combustion gas exit temperature, as represented by the conventionally known profile and peak pattern factors, efficiency of combustion, and the amount of exhaust emissions from low to high power operation. A relatively large length-to-height ratio is generally desirable for obtaining acceptable combustion gas exit temperature uniformity and relatively low unburned hydrocarbon and CO emissions. However, a relatively large length-to-height ratio results in a relatively long combustor which is generally undesirable for its relative increase in weight and surface area which requires cooling, and for the increased production of $NO_x$ emissions. Combustion gas residence time is the amount of time combustion occurs in the combustor and relatively long residence times reduce unburned hydrocarbons and CO but increase $NO_x$ production when at high temperature.

Accordingly, it is a primary objective in gas turbine engine combustor design to have relatively compact and short combustors which provide a good balance between competing objectives including reduced exhaust emissions, reduced weight, and acceptable exit temperature uniformity. Combustors which are too short result in undesirable and excessive gas temperatures for a given annulus height, for example, or flame instability, or both, where dome height and burning length are reduced excessively.

Improved gas turbine engine combustor concepts have been studied for improving efficiency thereof while obtaining reduced exhaust emissions among other objectives. One such study includes the National Aeronautics and Space Administration (NASA) Energy Efficient Engine ($E^3$) program in which advanced, short length, double annular or double dome combustors were designed and evaluated. A double dome combustor, such as for example, the $E^3$ combustor, includes two parallel radially outer and inner combustion zones each having a burning length-to-dome height ratio. The double dome combustor includes an outer dome having a plurality of circumferentially spaced outer carburetors therein, and an inner dome having a plurality of circumferentially spaced inner carburetors therein. Each of the length-to-height ratios is generally equal to conventional single dome length-to-height ratios for obtaining acceptable performance, while obtaining a relatively short combustor. For example, a double dome combustor can be sized for replacing a comparable single dome combustor having equivalent dome airflow in about half its length since if both the length and dome heights are reduced in half, the same length-to-height ratio can be obtained in half the length. Since each of the length-to-height ratios of the two combustion zones in the double dome combustor is generally equal to the length-to-height ratio of the corresponding single dome combustor, the equivalent exit temperature pattern factor can be achieved with a 50% reduction in combustor length. The combustion zone residence time is also reduced by about 50%.

Accordingly, conventional double dome combustors as studied in the literature can be effective for reducing overall combustor size while obtaining comparable or improved performance over the wide power range required during operation of an aircraft gas turbine engine.

However, various double dome combustor concepts are known in the literature which operate at varying degrees of efficiency and performance, and have different sizes. It is generally desirable to obtain yet further decreases in combustor length for further reducing weight and surface area, and therefore reducing cooling air requirements thereof, while still obtaining acceptable low to high power operation including reduced exhaust emissions and acceptable mixing of the combustion gases and dilution air for obtaining acceptably uniform combustion gas exit temperatures.

OBJECTS OF THE INVENTION

Accordingly, one object of the present invention is to provide a new and improved double dome combustor for use in an aircraft gas turbine engine operable from low to high power conditions, and a new improved method of operation.

Another object of the present invention is to provide a double dome combustor having a decreased length.

Another object of the present invention is to provide a double dome combustor having a decreased dome height.

Another object of the present invention is to provide a double dome combustor having decreased combustion gas residence time.

DISCLOSURE OF INVENTION

A method of operating a double dome combustor includes channeling compressed airflow through an inner dome for generating inner combustion gases having an inner reference velocity greater than an outer reference velocity of outer combustion gases generated from compressed airflow channeled through an outer dome, and diffusing the outer and inner combustion gases in outer and inner combustion zones. One double dome combustor effective for practicing the method in accordance with the present invention includes outer and inner combustor liners and domes, with the domes having outer and inner carburetors disposed therein, respectively. The inner carburetors are sized for generating inner combustion gases in the inner combustion zone having an inner reference velocity greater than an outer reference velocity of the outer combustion gases generated in the outer combustion zone. In a preferred embodiment, the combustor includes an annular centerbody which, along with the combustor outer and inner liners, defines diverging outer and inner combustion zones.

BRIEF DESCRIPTION OF DRAWINGS

The novel features believed characteristic of the invention are set forth and differentiated in the claims. The invention, in accordance with a preferred, exemplary embodiment, together with further objects and advantages thereof, is more particularly described in the following detailed description taken in conjunction with the accompanying drawing in which:

MODE(S) FOR CARRYING OUT THE INVENTION

Figure 1:
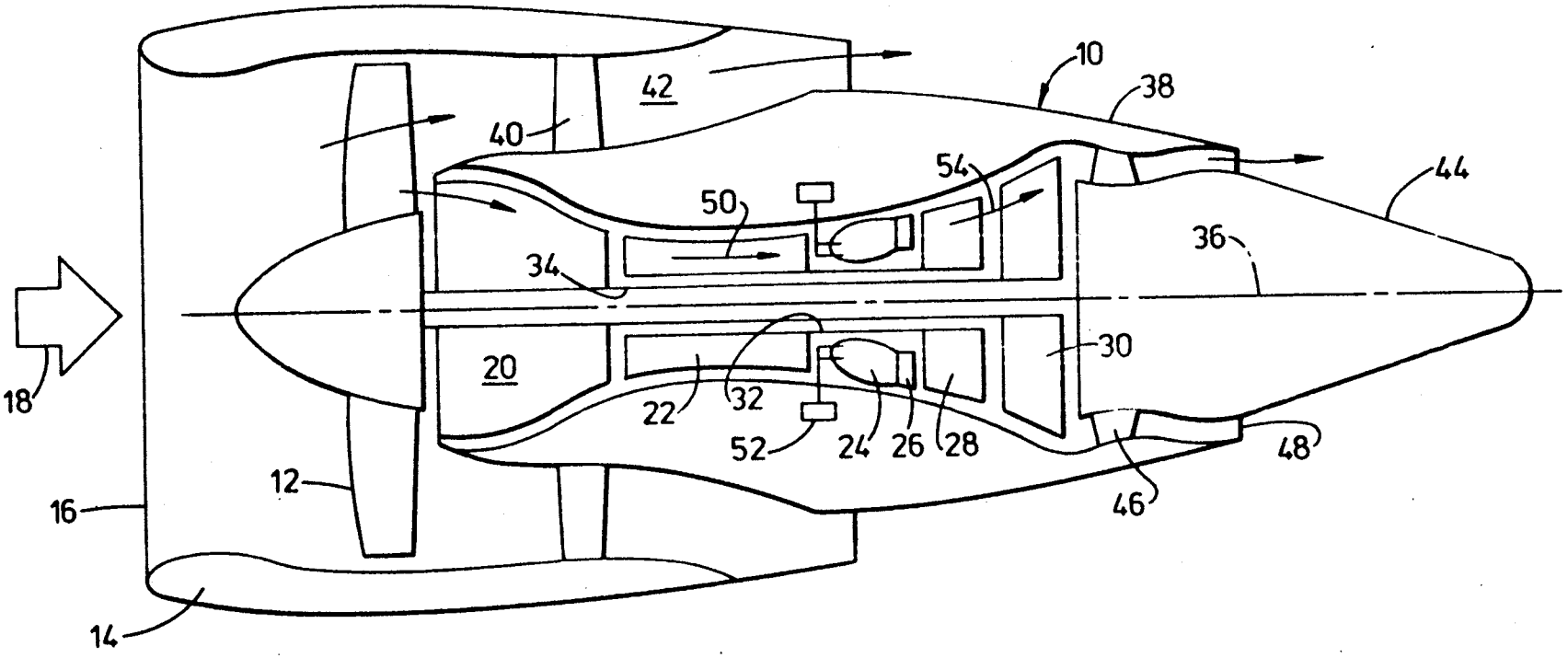
FIG. 1 is a longitudinal sectional schematic representation of an aircraft gas turbine turbofan engine having a double dome combustor in accordance with one embodiment of the present invention.

Illustrated in FIG. 1 is a longitudinal sectional schematic view of a high bypass turbofan engine 10 effective for powering an aircraft (not shown) in flight. The engine 10 includes a conventional fan 12 disposed inside a fan cowl 14 having an inlet 16 for receiving ambient airflow 18. Disposed downstream of the fan 12 is a conventional low pressure compressor (LPC) 20 followed in serial flow communication by a conventional high pressure compressor (HPC) 22, a combustor 24 in accordance with a preferred and exemplary embodiment of the present invention, a conventional high pressure turbine nozzle 26, a conventional high pressure turbine (HPT) 28, and a conventional low pressure turbine (LPT) 30. The HPT 28 is conventionally fixedly connected to the HPC 22 by an HP shaft 32, and the LPT 30 is conventionally connected to the LPC 20 by a conventional LP shaft 34. The LP shaft 34 is also conventionally fixedly connected to the fan 12. The engine 10 is symmetrical about a longitudinal centerline axis 36 disposed coaxially with the HP and LP shafts 32 and 34.

The fan cowl 14 is conventionally fixedly attached to and spaced from an outer casing 38 by a plurality of circumferentially spaced conventional struts 40 defining therebetween a conventional annular fan bypass duct 42. The outer casing 38 surrounds the engine 10 from the LPC 20 to the LPT 30. A conventional exhaust cone 44 is spaced radially inwardly from the casing 38 and downstream of the LPT 30, and is fixedly connected thereto by a plurality of conventional, circumferentially spaced frame struts 46 to define an annular core outlet 48 of the engine 10.

During operation, the airflow 18 is compressed in turn by the LPC 20 and HPC 22 and is then provided as pressurized compressed airflow 50 to the combustor 24. Conventional fuel injection means 52 provide fuel **52*a* (FIG. 2) to the combustor 24 which is mixed with the compressed airflow 50 and undergoes combustion in the combustor 24 for generating combustion discharge gases 54. The gases 54 flow in turn through the HPT 28 and the LPT 30 wherein energy is extracted for rotating the HP and LP shafts 32 and 34 for driving the HPC 22, and the LPC 20 and fan 12**, respectively.

Figure 2:
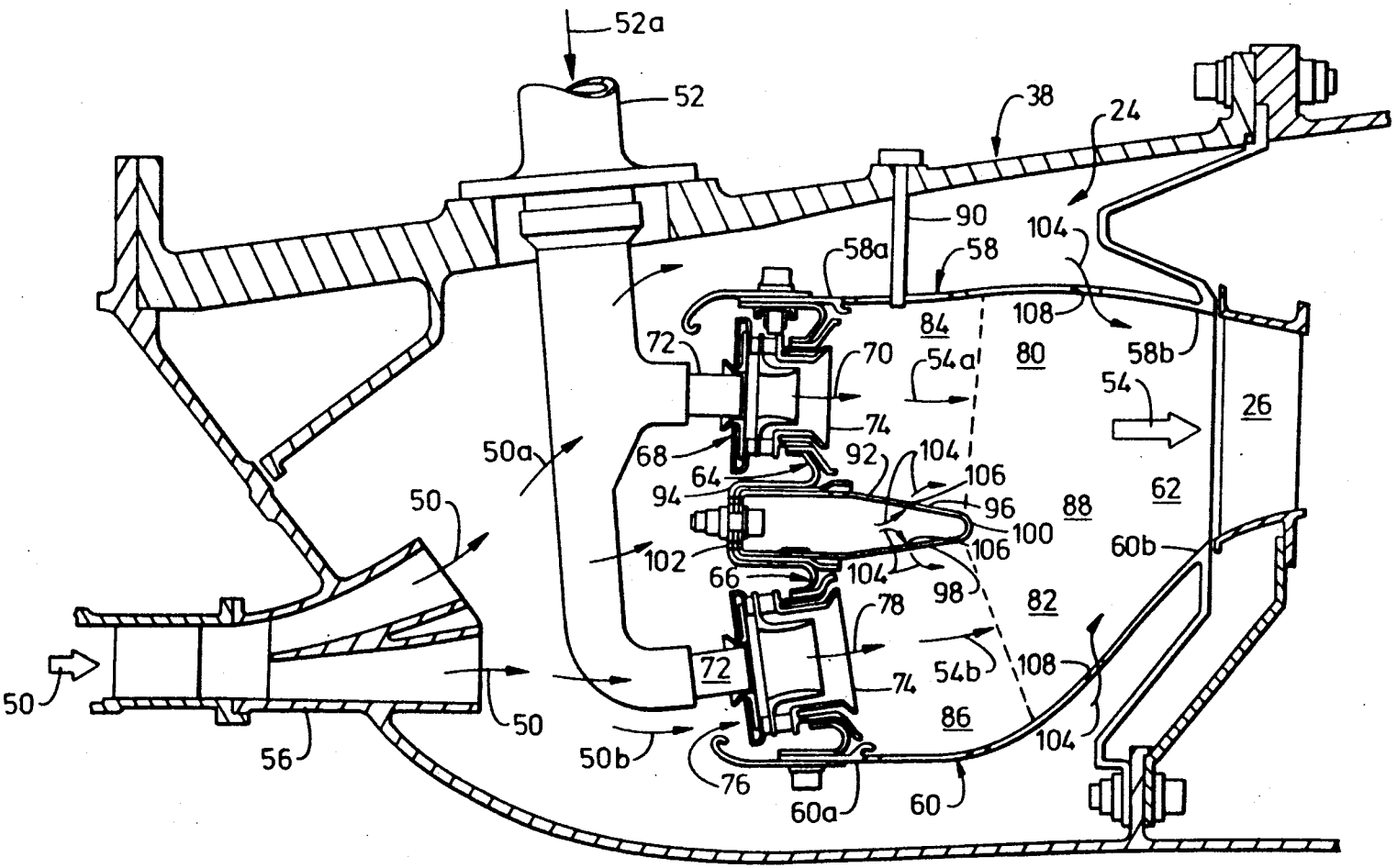
FIG. 2 is a longitudinal sectional view of the double dome combustor illustrated in FIG. 1, including the structures adjacent thereto.

Illustrated in FIG. 2 is a longitudinal sectional view of the combustor 24 in accordance with one embodiment of the present invention. Disposed upstream of the combustor 24 is a diffuser 56 which reduces the velocity of the compressed airflow 50 received from the HPC 22 for increasing its pressure and channeling the pressurized airflow 50 to the combustor 24.

The combustor 24 includes annular, radially outer and inner liners 58 and 60, respectively, disposed coaxially about the centerline axis 36. The outer liner 58 includes an upstream end **58*a* and a downstream end 58*b*, and the inner liner 60 includes an upstream end 60*a* and a downstream end 60*b*, the downstream ends 58*b* and 60*b* defining therebetween an annular combustor outlet 62**.

An annular, radially outer dome 64 is conventionally fixedly joined at its radially outer end to the outer liner upstream end **58*a* by bolts, including nuts threaded thereon. An annular, radially inner dome 66 is joined at its radially inner end to the inner liner upstream end 60*a*** by conventional bolts.

A plurality of conventional, circumferentially spaced outer carburetors 68 are conventionally joined to the outer dome 64, by brazing for example, for providing an outer fuel/air mixture 70 into the combustor 24. Each of the outer carburetors 68 includes a conventional fuel injector nozzle 72 disposed in a conventional counterrotational air swirler 74. The fuel **52*a* from the nozzle 72 is conventionally mixed with an outer portion 50*a* of the compressed airflow 50 channeled through the swirler 74 for generating the fuel/air mixture 70**.

A plurality of conventional, circumferentially spaced inner carburetors 76, each including a fuel injector nozzle 72 and a counterrotational air swirler 74, are conventionally fixedly connected to the inner dome 66 for providing an inner fuel/air mixture 78 into the combustor 24. The fuel **52*a* from the nozzle 72 is conventionally mixed with an inner portion 50*b* of the compressed airflow 50 channeled through the swirler 74 for generating the fuel/air mixture 78**.

The outer and inner liners 58 and 60 and the outer and inner domes 64 and 66 define therebetween an outer, or pilot, burner 80 extending downstream from the outer dome 64 to the outlet 62, and an inner, or main burner 82 extending downstream from the inner dome 66 to the outlet 62. They also define an outer combustion zone 84 and an inner combustion zone 86 extending downstream from the outer and inner domes 64 and 66, respectively, for generating therein outer and inner combustion gases **54*a* and 54*b*** from the outer and inner fuel/air mixtures, respectively.

The outer and inner liners 58 and 60 also define therebetween an annular dilution, or mixing zone 88 which is in flow communication with the outer and inner combustion zones 84 and 86 for receiving and mixing the outer and inner combustion gases **54*a* and 54*b* for providing the diluted combustion gases 54** as described in further detail hereinbelow.

A conventional igniter 90 extends through the outer casing 38 and the outer liner 58 into the outer combustion zone 84 for igniting the outer fuel/air mixture 70 for initiating combustion thereof. The outer combustion gases **54*a* in turn ignite the inner fuel/air mixture 78 for generating the inner combustion gases 54*b***.

The combustor 24 further includes in the preferred embodiment, a hollow annular centerbody 92 having a forward end 94 conventionally fixedly connected to the radially inner end of the outer dome 64 and the radially outer end of the inner dome 66 by conventional bolts. The centerbody 92 further includes radially spaced apart outer and inner walls 96 and 98, respectively extending downstream from the forward end 94 to join at an aft end 100 of the centerbody 92.

In the preferred embodiment, the centerbody outer and inner walls 96 and 98 converge from the forward end 94 to the aft end 100 so that the centerbody outer wall 96 and the outer liner 58 define therebetween a diverging outer combustion zone 84 for diffusing the outer combustion gases 54*a*. Similarly, the centerbody inner wall 98 and the inner liner 60 define therebetween a diverging inner combustion zone 86 for diffusing the inner combustion gases 54*b*. The dilution zone 88 is defined between the outer and inner liners 58 and 60 extending downstream from the centerbody aft end 100 wherein the outer and inner combustion gases 54*a* and 54*b* are conventionally mixed with dilution air for providing an acceptable exit temperature distribution of the combustion gases 54 at the outlet 62.

More specifically, a portion of the compressed airflow 50 is channeled through an inlet 102 disposed in the centerbody forward end 94 for cooling the centerbody 92 and for providing, for example, a portion of dilution air, indicated generally at 104 into the downstream ends of the outer and inner combustion zones 84 and 86. The dilution air 104 is channeled through a plurality of dilution apertures 106 disposed adjacent to the centerbody aft end 100 in the centerbody outer and inner walls 96 and 98. Additional dilution air 104 is conventionally channeled through dilution holds 108 in the combustor outer and inner liners 58 and 60 into the dilution zone 88 of the pilot and main burners 80 and 82.

The outer and inner combustion zones 84 and 86 each preferably diverges and has an increasing flow area in the downstream direction from the outer and inner domes 64 and 66, respectively, to the centerbody aft end 100. This allows the outer and inner combustion gases 54*a* and 54*b* to diffuse from the respective outlets of the outer and inner carburetors 68 and 76 to the centerbody aft end 100 for promoting mixing of the combustion gases 54*a* and 54*b* between the pilot and main burners 80 and 82. The improved mixing of the combustion gases and the dilution air 104 being mixed therewith improves the uniformity of the exit temperatures of the combustion gases 54 at the outlet 62, as well as improving ignition of the inner fuel/air mixture 78 from the outer combustion gases 54*a*. Furthermore, the diffusing effect on the outer combustion gases 54*a* provides a local increase in residence time of the outer combustion gases 54*a* which reduces exhaust emissions, for example unburned hydrocarbons and CO, as well as for providing improved profile and peak pattern factors at the outlet 62.

In the preferred embodiment, an increased rate of diffusion of the outer combustion gases 54*a* is obtained by utilizing an outer liner 58 which is convex radially outwardly in longitudinal section as illustrated in FIG. 2 between the outer liner upstream end 58*a* and the outer liner downstream end 58*b* in the outer combustion zone 84. In this way, an increased rate of diffusion of the outer combustion gases 54*a* may be obtained from the outer dome 64 at the discharge of the outer carburetors 68 to at least the centerbody aft end 100.

In a preferred embodiment, the outer liner 58, centerbody walls 96, 98, and the inner liner 60 are configured for maximizing the rate of flow area increase within the available length between the domes 64, 66 and the centerbody aft end 100 while maintaining diffusion of the combustion gases 54*a*, 54*b*.

Figure 3:
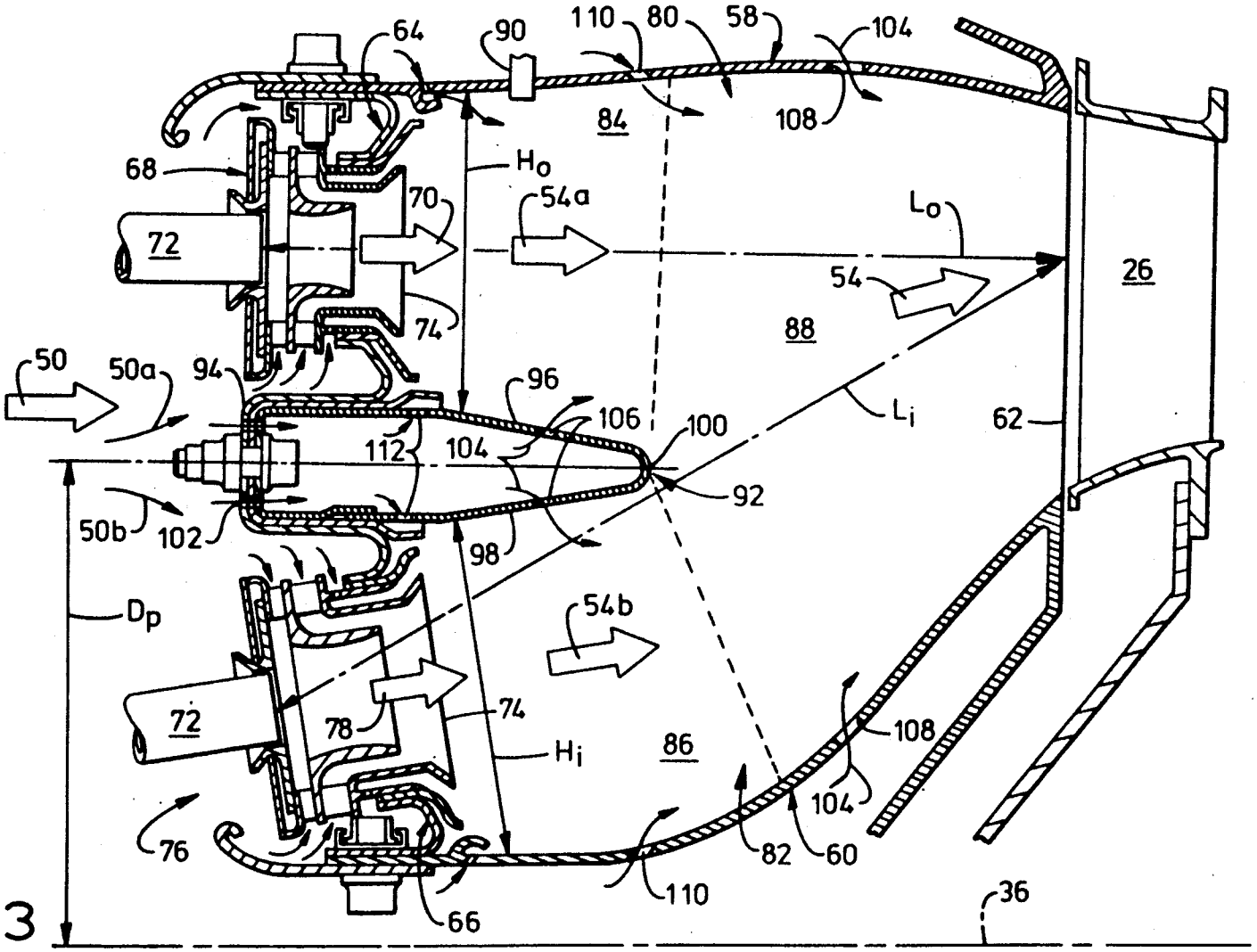
FIG. 3 is an enlarged longitudinal sectional view of the combustor illustrated in FIG. 2.

Illustrated in FIG. 3 is an enlarged longitudinal sectional view of the combustor 24 illustrated in FIG. 2. The compressed airflow 50 provided from the HPC 22 is channeled in part through the outer and inner domes 64 and 66 for generating the outer and inner combustion gases 54*a* and 54*b*; and in part through the dilution holes 108 in the outer and inner liners 58 and 60 for providing dilution of the combustion gases; and in part through conventional liner cooling holes 110, only an exemplary one of which is shown in each of the outer and inner liners 58 and 60 for providing bore and film cooling of the liners. A portion of the compressed airflow 50 is also provided through the centerbody inlet 102 for cooling the centerbody 92 through film cooling holes 112 and through the centerbody dilution apertures 106 for additionally supporting dilution of the combustion gases 54.

The outer and inner domes 64 and 66 are predeterminedly sized for having respective dome annulus areas conventionally proportional to respective dome annulus heights $H_o$ and $H_i$, measured between the outer liner 58 and the centerbody outer wall 96, and the inner liner 60 and the centerbody inner wall 98 at the outlet ends of the outer and inner carburetors 68 and 76, respectively. The outer and inner domes 64 and 66 are predeterminedly sized for receiving from the compressor 22 a portion of the compressed airflow 50 having a dome total weight, or mass, flowrate W. The outer carburetors 68, in particular the swirlers 74 thereof, are predeterminedly sized for channeling the outer portion 50*a* of the compressed airflow 50 having a first portion $W_1$ of the total dome flowrate W through the outer dome 64 into the outer combustion zone 84, which is mixed with the fuel 52*a*, for generating the outer fuel/air mixture 70 having an outer reference velocity $V_o$ which is conventionally effective for obtaining acceptable ignition and flame stability, among other conventional performance parameters at and above the ground idle power condition. The outer fuel/air mixture is ignited by the igniter 90 for generating the outer combustion gases 54*a* which also flow at the outer reference velocity $V_o$.

A conventional combustor is designed for obtaining a comparable reference velocity ($V_o$) which is relatively low for providing acceptable ignition and low power operation of the combustor. The reference velocity may be defined as the mass or weight flowrate of the airflow channeled through the flow area divided by the product of the density of the compressed airflow channeled to the dome and the the dome (such as the dome annulus areas at $H_O$ and $H_i$ described above) flow area in. The reference velocity is generally uniform from low to high power operation of the combustor since density and flowrate are inversely proportional to each other. A relatively low reference velocity is provided for obtaining relatively long combustor residence times for reducing unburned hydrocarbons and CO emissions, for providing acceptable flameout margin, for providing acceptable ground and air starting, and for obtaining acceptable flame stability among other conventional factors.

However, the use of a relatively low reference velocity is a compromise, for example, with respect to exhaust emissions wherein unburned hydrocarbons and CO emissions decrease as the reference velocity decreases, and $NO_x$ emissions increase as the reference velocity increases. By using the double annular combustor 24, the outer reference velocity $V_o$ may be maintained at conventional values of about 25 to 30 feet/-second (about 7.6 to about 9.1 meters/second) for obtaining relatively low unburned hydrocarbon and CO emissions in the pilot burner 80 during low power operation, while in the main burner 82 a relatively high inner reference velocity may be maintained for obtaining improved performance including a reduction in $NO_x$ emissions from the combustor 24.

More specifically, the inner carburetors 76, in particular the swirlers 74, are predeterminedly sized for channeling the inner portion 50*b* of the compressed airflow 50 having a second portion $W_2$ of the total dome flowrate W, wherein W is equal to $W_1+W_2$, through the inner dome 66 into the inner combustion zone 86, which is mixed with the fuel 52*a*, for generating the inner fuel/air mixture 78 having an inner reference velocity $V_i$ which is greater than the outer reference velocity $V_o$. The inner combustion gases 54*b* are generated from the inner fuel/air mixture 78 and therefore also flow at the inner reference velocity $V_i$. The conventional, outer reference velocity $V_o$ provides acceptable ignition and flame stability in the pilot burner 80, whereas the relatively high inner reference velocity $V_i$ in the main burner 82 provides improved performance including a reduction in $NO_x$ emissions during operation of the combustor 24 at high power levels greater than the ground idle power condition.

More significantly, and in accordance with one feature of the present invention, the higher inner reference velocity $V_i$ can be obtained by transferring a portion of the compressed airflow 50 from the outer dome 64 to the inner dome 66 for obtaining a yet further decrease in length, as well as dome height, of the double dome combustor 24 as compared to conventionally studied double dome combustors such as the NASA/$E^3$ double dome combustor mentioned above.

The significance of this advantage of the present invention may be appreciated by way of analogy. Take for example, an exemplary double dome combustor wherein the outer dome channels half of the dome airflow i.e. 50% W for obtaining a conventional reference velocity $V_{ref}$ in the outer burner, and the inner dome channels half of the dome airflow i.e. 50% W for obtaining the same reference velocity $V_{ref}$ in the inner burner. In this example, this reference double dome combustor also has a burner length to dome annulus height ratio i.e. L/H, for each of the outer and inner burners which are equal to each other, and equal dome airflow areas 50%A ("A" being the total airflow area through both domes).

Since the reference velocity $V_{ref}$ is directly proportional to the dome air flowrate and inversely proportional to the dome airflow area and density, the same reference velocity $V_{ref}$ (i.e. $V_{ref}=f(25\%\ W/25\%\ A)$ may be obtained in a yet smaller double dome combustor by, for example, decreasing the area, or decreasing the dome height H, by half (i.e. 25% A) and by reducing the dome air flowrate also by half (i.e. 25% W). If the entire double dome combustor is reduced in length and dome height by half for obtaining a ½ reduction in dome flow area of the outer and inner burners (i.e. 25% A), then the reference velocity in the inner burner must at least double in value (i.e. $2V_{ref}=f(50\%\ W/25\%\ A)$) if the same amount of dome airflow (i.e. 50% W) is channeled through the resulting half flow area (i.e. 25% A). However, the half reduction in airflow in the outer dome (i.e. 25% W) may instead be provided in accordance with the present invention to the inner dome for yet further increasing the reference velocity therein another 50% (i.e. $3V_{ref}=f(75\%\ W/25\%\ A)$).

Accordingly, the initial double dome reference combustor having in the outer dome and in the inner dome equal flowrates 50% W, equal flow areas 50% A, equal L/H ratios, and equal reference velocities $V_{ref}$, may be reconfigured to a second double dome combustor having half the length and half the respective dome height for obtaining the same L/H ratios in each of the outer and inner burners, and with 25% W channeled through the outer dome resulting in the same reference velocity $V_{ref}$ as in the reference double dome combustor, with 75% W through the inner dome resulting in three times the reference velocity in the inner burner.

By this analogy, the reference double dome combustor having the conventional reference velocity in the inner and outer burners, can be reduced 50% in size, for example, with a resulting smaller double dome combustor also having the same reference velocity in the outer burner while obtaining a substantially higher reference velocity in the inner burner. Of course, the actual reduction in double dome combustor size must be determined for each design application. A conventional, low reference velocity is maintained in the pilot burner, while an increase in reference velocity is obtained in the main burner, subject to conventional limits on acceptable performance of the combustor including for example, flameout margin, ignition, flame stability, and pressure loss resulting from combustion heat addition at relatively high Mach number. The combustor 24 can therefore be predeterminedly sized for being operated with the inner reference velocity of the main burner 82 greater than the outer reference velocity of the pilot burner 80 for obtaining a yet smaller double dome combustor as compared to conventional double dome combustors.

A method of operating the double dome combustor 24 in accordance with one embodiment of the present invention as described above therefore includes diffusing the outer and inner combustion gases for providing improved mixing thereof and channeling the compressed airflow to the outer and inner domes for obtaining the inner reference velocity greater than the outer reference velocity. In the preferred embodiment of the present invention, the inner reference velocity $V_i$ being greater than the outer reference velocity $V_o$ is obtained by channeling a larger portion of the dome total flowrate (i.e. $W_2$) to the inner dome than to the outer dome (i.e. $W_1$). More specifically, the method further includes channeling the compressed airflow inner portion 50*b* through the inner dome 66 at the flowrate second portion $W_2$ which is greater than the flowrate first portion $W_1$ so that the inner reference velocity $V_i$ is greater than the outer reference velocity $V_o$.

The maximum value of the inner reference velocity $V_i$ is about 100 feet/second (about 30 meters/second) because of the conventional limits described above. In one embodiment of the present invention, the outer reference velocity is about 26 feet/second (about 8 meters/second) and the inner reference velocity is about 48 feet/second (about 15 meters/second).

Again referring to FIG. 3, the outer burner 80 includes an outer burning length $L_o$ defined from the outer carburetors 68 at the exit of the nozzle 72 to about the midportion of the combustor outlet 62 which is substantially identical to the inlet to the nozzle 26. The inner, main burner 82 similarly has an inner burning length $L_i$ defined from the inner carburetors 76 at the exit of the nozzle 72 to about the midportion of the combustor outlet 62. The combustor 24 also has a pitch diameter $D_p$ defined as the diameter at the center of the forward end 94 of the centerbody 92. In the preferred embodiment, the outer burning length $L_o$ and the inner burning length $L_i$ are generally equal, for example about 6.7 inches (about 17 cm), the outer dome height $H_o$ is about 2.7 inches (about 6.9 cm), the inner dome height $H_i$ is about 2.1 inches (about 5.3 cm), and the pitch diameter $D_p$ is about 32 inches (about 81 cm). The length-to-height ratio $L_o/H_o$ of the outer burner 80 is about 2.5 and the length to height ratio $L_i/H_i$ of the inner burner 82 is about 3.2.

Accordingly, a relatively compact double dome combustor 24 is provided in accordance with the present invention, which is relatively small when considering the relatively large pitch diameter $D_p$. The length-to-pitch diameter ratio $L_i/D_p$ is about 0.21 in the preferred embodiment which is substantially less than that of conventional single annular combustors, and is less than the length-to-pitch diameter ratio of the NASA/$E^3$ double dome combustor which was about 0.3. The burning lengths of the NASA/$E^3$ combustor were about 7.0 inches (about 18 cm), and the pitch diameter through the centerbody thereof was about 23.6 inches (60 cm). The present double dome combustor 24 has a shorter burning length ($L_o$ and $L_i$), while having a substantially larger pitch diameter. The burning lengths $L_o$ and $L_i$ are less than 7.0 inches (less than 18 cm) and may even be less than 6.7 inches (17 cm) in accordance with the present invention.

The double dome combustor 24 in accordance with the present invention is effective for obtaining improved low power operation from start up to ground idle wherein only the pilot burner 80 is in operation with acceptable ground and air starting capability, acceptable flameout margin, and relatively low unburned hydrocarbons and CO emissions. The pilot burner 80 is effective for obtaining acceptable flame stability, and may be operated at a lean equivalence ratio, i.e. at ratios of the fuel/air mixture to the stoichiometric fuel/air ratio less than 1, with the relatively low outer reference velocity resulting in relatively long combustor residence time.

At high power operation above ground idle and through cruise and takeoff power conditions, the combustor 24 is effective for obtaining reduced $NO_x$ and smoke emissions, acceptably uniform combustion gas exit temperatures at the outlet 62, and relatively high combustion efficiency. The inner combustion gases **54*b* flow at a relatively high velocity which provides relatively high turbulence of the combustion gas flow which provides relatively rapid mixing thereof and mixing with the dilution air 104. At cruise conditions, a relatively low, lean equivalence ratio for the inner fuel/air mixture 78 may be obtained in the inner dome 66 with a relatively low, lean equivalence ratio for the outer fuel/air mixture 70 in the outer dome 64 for obtaining effective operation of the combustor 24. These lean equivalence ratios may be about twenty-five percent less than those found in conventional combustors. The relatively low equivalence ratio in the inner dome 66 of the main burner 82 is effective for providing reduced $NO_x$ emissions, and the $NO_x$ emissions may be further reduced by the relatively high velocity of the inner combustion gases 54 as represented by the relatively high inner reference velocity $V_i$. The combustion residence time in the main burner 82 is, therefore, substantially less than the combustion residence time in the pilot burner 80**, and in the preferred embodiment is about half the value thereof.

While there has been described herein what is considered to be a preferred embodiment of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims.

We claim:

1. A method of operating a double dome combustor having a longitudinal centerline axis at and above an idle power condition to a full power condition, said combustor having spaced apart radially outer and inner liners, and radially outer and inner domes joined to upstream ends of said outer and inner liners for defining outer and inner combustion zones extending downstream from said outer and inner domes, respectively, said combustor being provided with fuel and with compressed airflow, having a dome total airflow flowrate, to both said outer and inner domes, said method comprising:

channeling an outer portion of said compressed airflow having a first portion of said total dome flowrate through said outer dome into said outer combustion zone for generating outer combustion gases having an outer reference velocity effective for obtaining ignition and flame stability at and above said flight idle power condition;

channeling through said inner dome into said inner combustion zone above said flight idle power condition and up to said full power condition an inner portion of said compressed airflow having a second portion of said total dome flowrate for generating inner combustion gases having an inner reference velocity greater than said outer reference velocity;

diffusing said outer combustion gases in said outer combustion zone in longitudinal section from said outer dome; and diffusing said inner combustion gases in said inner outer combustion zone in longitudinal section from said inner dome.

2. A method of operating a double dome combustor according to claim 1 further including:

channeling said compressed airflow inner portion through said inner dome at said flowrate second portion greater than said flowrate first portion so that said inner reference velocity is greater than said outer reference velocity.

3. A method of operating a double dome combustor according to claim 1 further including channeling said compressed airflow outer portion through said outer dome for obtaining said outer reference velocity of about 26 feet/second (about 8 meters/second) and channeling said compressed airflow inner portion through said inner dome for obtaining said inner reference velocity of up to about 100 feet/second (up to about 30 meters/second).

4. A double dome combustor for a gas turbine engine having a longitudinal centerline axis and operable at and above an idle power condition to a full power condition comprising:

an annular, radially outer liner having upstream and downstream ends;

an annular, radially inner liner having upstream and downstream ends and being spaced inwardly from said outer liner;

an annular, radially outer dome joined to said outer liner upstream end and having a plurality of circumferentially spaced outer carburetors therein for providing an outer fuel/air mixture into said combustor;

an annular, radially inner dome joined to said inner liner upstream end and having a plurality of circumferentially spaced inner carburetors therein for providing an inner fuel/air mixture into said combustor;

said outer and inner liners and domes defining therebetween outer and inner combustion zones extending downstream from said outer and inner domes, respectively, for generating therein outer and inner combustion gases from said outer and inner fuel/air mixtures, said outer and inner combustion zones each being diverging in longitudinal section in a downstream direction from said outer and inner domes, respectively;

said outer and inner liners further defining therebetween an annular dilution zone in flow communication with said outer and inner combustion zones for receiving and mixing said outer and inner combustion gases;

said outer and inner domes being sized for receiving from a compressor compressed airflow having a dome total flowrate;

said outer carburetors being sized for channeling an outer portion of said compressed airflow having a first portion of said total dome flowrate through said outer dome into said outer combustion zone for generating said outer combustion gases having an outer reference velocity effective for obtaining ignition and flame stability at and above said flight idle power condition; and said inner carburetors being sized for channeling an inner portion of said compressed airflow having a second portion of said total dome flowrate through said inner dome into said inner combustion zone for generating said inner combustion gases having an inner reference velocity greater than said outer reference velocity.

5. A double dome combustor according to claim 4 further including an annular centerbody having:

a forward end fixedly joined to said outer and inner domes;

radially spaced apart outer and inner walls extending downstream from said forward end; and an aft end;

said centerbody outer wall and said outer liner defining therebetween said diverging outer combustion zone;

said centerbody inner wall and said inner liner defining therebetween said diverging inner combustion zone; and said dilution zone being defined between said outer and inner liners downstream of said centerbody aft end.

6. A double dome combustor according to claim 5 wherein said centerbody outer and inner walls converge from said forward end to said aft end thereof.

7. A double dome combustor according to claim 6 wherein said outer liner is convex radially outwardly in longitudinal section between said outer liner upstream end and said outer inner downstream end for diffusing said outer combustion gases in said outer combustion zone.

8. A double dome combustor according to claim 7 wherein said inner and outer carburetors are sized for channeling said compressed airflow inner portion through said inner dome at said flowrate second portion greater than said flowrate first portion so that said inner reference velocity is greater than said outer reference velocity.

9. A double dome combustor according to claim 8 wherein said inner and outer carburetors are sized for obtaining said outer reference velocity of about 26 feet/second (about 8 meters/second) and said inner reference velocity of up to about 100 feet/second (up to about 30 meters/second).

10. A double dome combustor according to claim 7 wherein said combustor further includes:

an outlet joining said downstream ends of said outer and inner liners for discharging said outer and inner combustion gases;

an outer burning length $L_o$ defined from said outer carburetors to said outlet;

an inner burning length $L_i$ defined from said inner carburetors to said outlet;

an outer dome height $H_o$ defined between said combustor outer liner and said centerbody outer wall;

an inner dome height $H_i$ defined between said combustor inner liner and said centerbody inner wall;

a pitch diameter $D_p$ defined at said centerbody; and the outer length-to-height ratio $L_o/H_o$ is about 2.5, and the inner length-to-height ratio $L_i/H_i$ is about 3.2.

11. A double dome combustor according to claim 10 wherein the length-to-pitch diameter ratio $L_i/D_p$ is about 0.21.

12. A double dome combustor according to claim 10 wherein said outer and inner burning lengths $L_o$ and $L_i$ are generally equal.

13. A double dome combustor according to claim 12 wherein said outer and inner burning lengths $L_o$ and $L_i$ are about 6.7 inches (about 17 cm).

14. A double dome combustor according to claim 13 wherein the length-to-pitch diameter ratio $L_i/D_p$ is about 0.21.

* * * * *